US006687996B2

(12) United States Patent
Smatloch et al.

(10) Patent No.: US 6,687,996 B2
(45) Date of Patent: Feb. 10, 2004

(54) METHOD OF MAKING AN EXHAUST GAS COLLECTOR

(75) Inventors: Christian Smatloch, Paderborn (DE); Artur Lesch, Steinheim (DE); Ingo Toparkus, Rietberg (DE); Gerhard Steinbach, deceased, late of Willebadessen (DE), by Ingrid Pauline Steinbach, heir; Jürgen Kleinschmidt, Beverungen (DE)

(73) Assignee: Benteler Automobiltechnik GmbH & Co. KG, Paderborn (DE)

( * ) Notice: Subject to any disclaimer, the term of this patent is extended or adjusted under 35 U.S.C. 154(b) by 17 days.

(21) Appl. No.: 10/050,594

(22) Filed: Jan. 16, 2002

(65) Prior Publication Data

US 2002/0116819 A1 Aug. 29, 2002

(30) Foreign Application Priority Data

Jan. 23, 2001 (DE) ..... 101 02 896

(51) Int. Cl.[7] ..... B21D 51/16

(52) U.S. Cl. ..... 29/890.08; 29/890; 29/890.053; 29/890.145; 29/890.147; 29/421.1

(58) Field of Search ..... 29/890.08, 897, 29/890, 897.2, 421.1, 890.14, 890.145, 890.147, 890.053, 33 D, 33 T; 72/370.03, 370.08, 57, 58, 370.22; 60/323

(56) References Cited

U.S. PATENT DOCUMENTS 4,732,025 A * 3/1988 Marlinga et al. ..... 72/18.5
5,148,597 A * 9/1992 Weeks ..... 29/890.08
5,333,775 A * 8/1994 Bruggemann et al. ..... 228/157
5,471,857 A * 12/1995 Dickerson ..... 72/57
5,572,868 A * 11/1996 Okamoto et al. ..... 60/323
5,644,829 A * 7/1997 Mason et al. ..... 29/421.1
5,682,741 A * 11/1997 Augustin et al. ..... 60/323
5,697,155 A * 12/1997 Bloecker et al. ..... 29/890.148
5,735,156 A * 4/1998 Yoshitomi et al. ..... 72/57
5,816,045 A * 10/1998 Blocker et al. ..... 60/323
6,026,570 A * 2/2000 Bohm et al. ..... 29/890.08
6,038,769 A * 3/2000 Bonny et al. ..... 29/890.08
6,279,364 B1 * 8/2001 Morphy et al. ..... 72/58
6,343,417 B1 * 2/2002 Bonny et al. ..... 29/890.08

FOREIGN PATENT DOCUMENTS

DE 43 39 290 A1 5/1995
DE 195 10 602 C1 4/1996
JP 6-81642 * 3/1994

* cited by examiner

*Primary Examiner*—Charles T. Jordan
*Assistant Examiner*—T. Nguyen
(74) *Attorney, Agent, or Firm*—Henry M. Feiereisen

(57) ABSTRACT

In a method of making an exhaust gas collector, a collector housing is made from a tubular blank, and subsequently, an inlet duct is formed through a widening process to provide a substantially rectangular cross section with rounded narrow sides. The inlet duct is provided with a head flange. At the outlet side, the collector housing is necked by a press-forming process so as to shape an outlet duct having a substantially circular cross section which is reduced in size compared to the cross section of the collector housing. Attached to the outlet duct is an end flange.

10 Claims, 1 Drawing Sheet

METHOD OF MAKING AN EXHAUST GAS COLLECTOR

CROSS-REFERENCES TO RELATED APPLICATIONS

This application claims the priority of German Patent Application Serial No. 101 02 896.2, filed Jan. 23, 2001, the subject matter of which is incorporated herein by reference.

BACKGROUND OF THE INVENTION

The present invention relates to a method of making an exhaust gas collector for multi-cylinder internal combustion engines.

Exhaust gas collector or manifolds are used in internal combustion engines to conduct exhausts produced during combustion in several cylinders in a cost-efficient single-flow system to an exhaust aftertreatment system, in particular to reduce emissions and noise levels. Unlike exhaust manifolds, which are made by a casting process, exhaust gas collectors, with or without integrated catalytic converter, are normally made of a many individual parts. Conventional exhaust manifolds or exhaust gas collectors, involved here, are, for example, described in German Pat. Nos. DE 195 10 602 C1 or DE 43 39 290 C2.

The individual parts are predominantly connected together by fusion welding. Disregarding here the typically very complicated air-gap insulated exhaust gas collectors, single-wall exhaust gas collectors are basically fabricated according to one of the following three principles of construction:

Half-shell construction

Tube construction

Combined shell-tube construction

The exhaust gas collector has a collector housing which interconnects a head flange, which is disposed on the multi-cylinder outlet side of a power engine, and an end flange for attachment, normally in single-flow configuration, of the discharging exhaust system. It is also generally known to accommodate components of the catalytic converter in the collector housing.

It would be desirable and advantageous to provide an improved method of making a high-quality exhaust gas collector in a cost-efficient manner for multi-cylinder internal combustion engines.

SUMMARY OF THE INVENTION

According to one variation of the present invention, a method of making an exhaust gas collector for multi-cylinder internal combustion engines, includes the steps of providing a tubular blank having a cross sectional dimension which corresponds to a diameter of a collector housing for an exhaust gas collector to be fabricated, and forming the blank into the collector housing with an inlet duct of substantially rectangular cross section with rounded narrow sides. Examples of suitable shaping processes include bending and press-forming or a compression process, to impart the inlet duct with a rectangular cross section having flattened long sides and rounded narrow sides. Subsequently, components of a catalytic converter can be installed in such an exhaust gas collector through the outlet side, and the outlet duct can then be shaped.

According to another variation of the present invention, a method of making an exhaust gas collector for multi-cylinder internal combustion engines, includes the steps of shaping a tubular blank by an internal high pressure forming process into a collector housing, and forming the collector housing with an inlet duct of substantially rectangular cross section with rounded narrow sides. In accordance with this variation, the collector housing is made on the basis a tubular blank through application of an internal high pressure forming process, whereby the inlet duct is produced on the inlet side by widening the initial or intermediate profile into a substantially rectangular cross section with rounded narrow sides. Thus, the inlet duct constitutes a single-piece component of the collector housing.

Both variations of the present invention allow manufacture of exhaust gas collectors which are comprised of a minimum of two components, namely the head flange and the collector housing with integrated outlet duct. It is not necessarily required to use a circular tube as blank in order to make an exhaust gas collector. Also, oval or polygonal profiles may be utilized. An exhaust gas collector according to the present invention can be made more cost-efficient because no welding operations are required, and also because the need for different tools is lessened in order to make the individual components. In particular, the absence of inhomogeneities, such as weld seams and overlaps, leads to an extended service life of an exhaust gas collector according to the present invention, which can be made for configurations with or without catalytic converter.

When integrating a catalytic converter in the collector housing, the collector housing is first formed with the inlet duct. Subsequently, the catalytic converter system, i.e., carrier and retaining mat, is fitted into the collector housing. This process is known in the art also as "canning". Then, the collector housing is subjected to a press-forming process to neck the outlet duct of substantially circular cross section in relation to the cross section of the collector housing.

Once the collector housing is produced, it is merely required to attach the head flange to the inlet duct. This may be realized through a welding operation.

Optionally, an end flange may be attached to the outlet duct. Depending on the size of the exhaust pipe, it is also possible to omit the provision of an end flange altogether. In this case, it is conceivable to form a bulbous portion on the end of the collector housing during press-forming of the outlet duct. A positive connection can then be implemented with the discharging exhaust pipe, for example, by means of a spring element.

According to another feature of the present invention, the inlet duct may be connected by a curved pipe section to the collector housing. This type of construction is space-saving and efficient.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
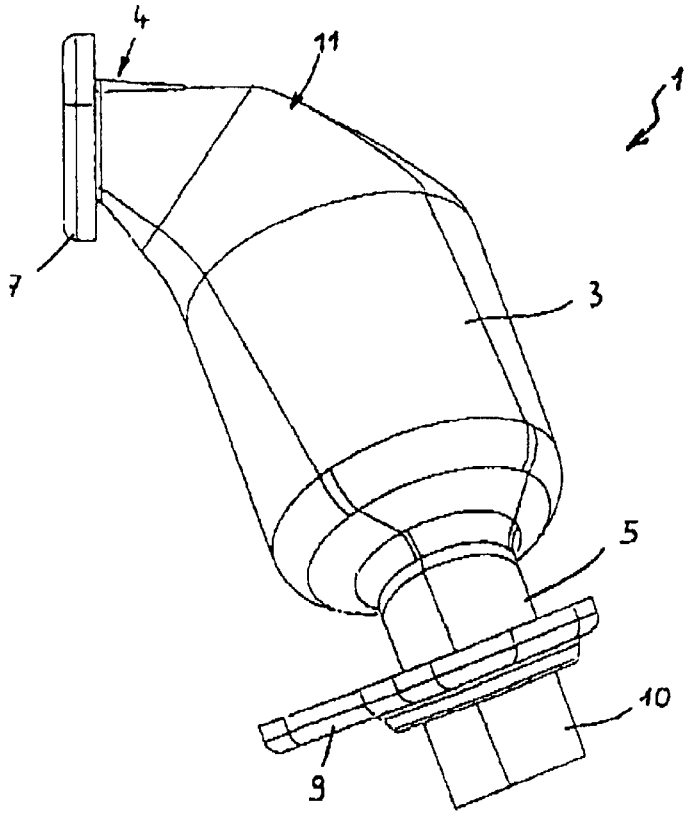
FIG. 1 is a side perspective of a first embodiment of an exhaust gas collector according to the present invention.

Throughout all the Figures, same or corresponding elements are generally indicated by same reference numerals.

Turning now to the drawing, and in particular to FIG. 1, there is shown a side perspective of a first embodiment of an exhaust gas collector according to the present invention, generally designated by reference numeral 1, for use in multi-cylinder internal combustion engines to conduct exhausts produced during combustion in the cylinders in a single-flow system to an exhaust aftertreatment, especially for reducing emission and noise. The exhaust gas collector 1 includes a collector housing 3 formed with an inlet duct 4 and an outlet duct 5. The collector housing 3 may be realized through an internal high pressure forming process of a tubular blank, to thereby provide the collector housing 3 with a bulbous configuration. Subsequently, the inlet duct 4 is widened into an essentially rectangular cross section with rounded narrow sides 6 and flattened long sides. The configuration of the inlet duct 4 is indicated in the embodiment shown in FIG. 2 by dashdot line. Expansion of the inlet duct 4 can be realized by a tool, e.g., a mandrel.

Figure 2:
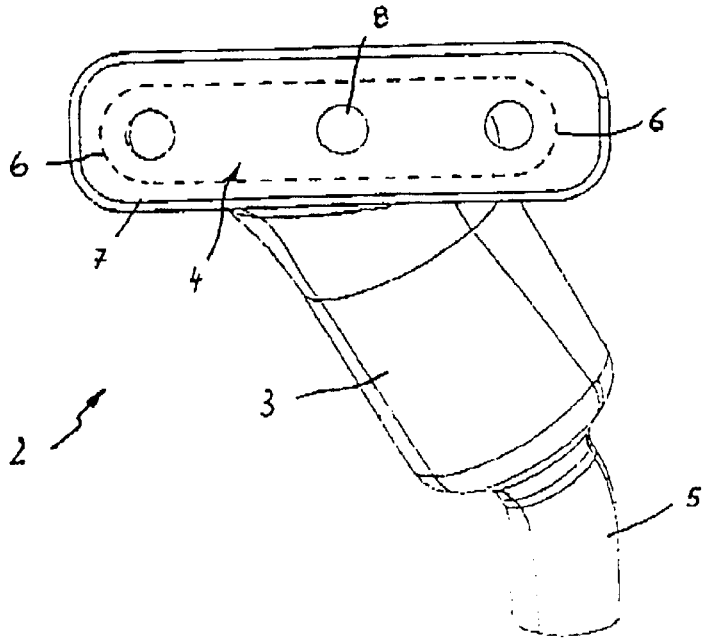
FIG. 2 is a perspective illustration of a second embodiment of an exhaust gas collector according to the present invention attached to a head flange.

FIG. 2 shows another embodiment of an exhaust gas collector according to the present invention, generally designated by reference numeral 2. Parts corresponding with those in FIG. 1 are denoted by identical reference numerals and not explained again. The collector housing 3 is also formed from a tubular blank having cross sectional dimensions corresponding to a diameter of the collector housing 3 being made. In the area of the collector housing 3, the blank is secured in place by an outer and/or inner support, not shown. Subsequently, the inlet duct 5 is shaped into the intended configuration through a forming process under a combination of tensile and compressive conditions as well as compression and widening.

The outlet duct 5 of the collector housing 3 is shaped through contraction or necking by means of a press-forming process to receive an essentially circular cross section which is reduced in relation to the cross section of the collector housing 3.

Once the collector housing 3 has been formed, it is only necessary to attach, e.g., by welding, a head flange 7 to the inlet duct 4. Disposed in the head flange 7 are inlet openings 8 for exhausts generated in the cylinders of the internal combustion engine.

As shown in FIG. 1, by way of example, the exhaust gas collector 1 may further include an end flange 9 joined to the outlet duct 5 for connecting a pipe 10 to the exhaust gas collector 1 so as to further conduct exhausts.

Unlike the exhaust gas collector 1, the exhaust gas collector 2 is comprised of only two parts, namely the collector housing 3 with integrated outlet duct 5 and the head flange 7 welded onto the collector housing 3. The outlet duct 5 is necked-in relative to the collector housing 3 through press-forming.

As shown in particular in FIG. 1, the inlet duct 4 terminates in a curved pipe section 11 for connection to the collector housing 3.

Common to both exhaust gas collectors 1, 2 is the ability to integrate a catalytic converter or components of catalytic converters in the collector housing 3. Hereby, the collector housing 3 is formed, then the catalytic converter system is installed, and then the outlet duct 5 is necked through press-forming.

While the invention has been illustrated and described as embodied in a method of making an exhaust gas collector, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method of making an exhaust gas collector for multi-cylinder internal combustion engines, comprising the steps of:

providing a tubular blank having a cross sectional configuaration which corresponds to a final configuration of a collector housing to be made for an exhaust gas collector;

forming the blank into the collector housing by shaping one end of the blank into an inlet duct of substantially rectangular cross section with rounded narrow sides;

attaching a head flange to the inlet duct;

fitting a catalytic converter inside the collector housing; and press-forming another opposite end of the collector housing to provide an outlet duct through contraction, so that the outlet duct has a cross section which is substantially round and reduced in size with respect to a cross section of the collector housing.

2. The method of claim 1, and further comprising the step of attaching an end flange to the outlet duct.

3. The method of claim 1, and further comprising the step of forming a bent pipe section for connecting the inlet duct to the collector housing.

4. The method of claim 1, wherein the inlet duct is formed through a widening process.

5. The method of claim 1, wherein the inlet duct is formed through a widening process by means of a mandrel.

6. A method of making an exhaust gas collector for multi-cylinder internal combustion engines, comprising the steps of:

shaping a tubular blank to a cross sectional configuration which corresponds to a final by an internal high pressure forming process configuaration of a collector housing;

forming the blank into the collector housing with an inlet duct of substantially rectangular cross section with rounded narrow sides;

attaching head flange to the inlet duct;

fitting a catalytic converter inside the collector housing; and press-forming the collector housing to provide an outlet duct through contraction, so that the outlet duct has a cross section which is substantially round and reduced in size with respect to a cross section of the collector housing.

7. The method of claim 6, and further comprising the step of attaching an end flange to the outlet duct.

8. The method of claim 6, and further comprising the step of forming a bent pipe section for connecting the inlet duct to the collector housing.

9. The method of claim 6, wherein the inlet duct is shaped by a forming process combining tensile and compressive forces.

10. The method of claim 6, wherein the inlet duct is formed through a widening and compression process.

* * * * *